US010212793B1

(12) United States Patent
Plancherel et al.

(10) Patent No.: US 10,212,793 B1
(45) Date of Patent: Feb. 19, 2019

(54) BANDWIDTH OPTIMIZATION FOR STREAMING LIGHTING EFFECTS

(71) Applicant: Logitech Europe S.A., Lausanne (CH)

(72) Inventors: Laurent Plancherel, Lusanne (CH); David Tarongi Vanrell, Epalinges (CH)

(73) Assignee: Logitech Europe S.A., Lausanne (CH)

( * ) Notice: Subject to any disclaimer, the term of this patent is extended or adjusted under 35 U.S.C. 154(b) by 0 days.

(21) Appl. No.: 16/036,753

(22) Filed: Jul. 16, 2018

(51) Int. Cl.
*H01H 13/83* (2006.01)
*H05B 37/02* (2006.01)
*H05B 33/08* (2006.01)

(52) U.S. Cl.
CPC ..... *H05B 37/0272* (2013.01); *H01H 13/83* (2013.01); *H05B 33/086* (2013.01); *H01H 2219/016* (2013.01); *H01H 2219/039* (2013.01)

(58) Field of Classification Search
CPC .... H05B 37/02; H05B 37/0272; H05B 33/08; H05B 33/086; H01H 13/83; H01H 2219/014; H01H 2219/016; H01H 2219/039
See application file for complete search history.

(56) References Cited

U.S. PATENT DOCUMENTS

2009/0206773 A1* 8/2009 Chang ..... H05B 33/086 315/297
2014/0335823 A1* 11/2014 Heredia ..... H04L 51/38 455/411
2018/0124895 A1* 5/2018 Alexander ..... G06F 3/041

* cited by examiner

*Primary Examiner* — Thai Pham
(74) *Attorney, Agent, or Firm* — Kilpatrick Townsend & Stockton LLP

(57) ABSTRACT

In embodiments, a method and system is provided for streaming lighting effect data wirelessly to a peripheral input device in lighting effect arrays. A current lighting effect array is compared to a previous lighting effect array, and compression is applied to one or more zones of light emitters in the lighting effect array.

20 Claims, 7 Drawing Sheets

BANDWIDTH OPTIMIZATION FOR STREAMING LIGHTING EFFECTS

BACKGROUND

The present invention relates to streaming effects (e.g., lighting) to a peripheral device (e.g., keyboard).

In corded peripheral devices such as keyboards, full duplex communication is possible, allowing for configuration data to be sent to from the host to the peripheral device while reporting data from the devices is simultaneously being sent back to the host. Such a communication arrangement is preferable in high-performance applications such as gaming because the transmission of configuration data cannot interfere with or pre-empt the reporting of data back from the peripheral device. If this were not the case, during configuration of the device (e.g., the setting of back lighting) data coming from the device (e.g., key activations) could be delayed or even lost, leading to a degraded user experience.

Some Logitech corded gaming keyboards provide the user with the ability to manage and customize animated lighting effects or choose from 16 preset lighting effects. The effects can be applied with a lighting effect array specifying the color for each key in a period of time.

For wireless devices, the issue is more complex. In some cases, two way communication with the peripheral device is done over a single wireless channel. In such cases configuration data sent to the device must be time multiplexed with reporting data sent from the device. If the configuration data is too large, it can consume a large amount of the bandwidth of the channel, leading to fewer time slots being available for data reporting. For existing lighting schemes, where keyboard keys are lit, typically a command needs to be sent for each light emitter. Furthermore, other wireless devices may cause interference on the channel further increasing the risk of lost and/or corrupted reporting data from the device. Accordingly, there exists a need for a system that can provide for improved wireless communication between a host and configurable peripheral device.

BRIEF SUMMARY

In embodiments, a method and system is provided for streaming lighting effect data wirelessly to a peripheral input device in lighting effect array messages. A current lighting effect array is compared to a previous lighting effect array, and a single lighting effect array command is applied to a plurality of light emitters in the lighting effect array.

In embodiments, a method and system is provided for streaming lighting effect data wirelessly to a peripheral input device in lighting effect array messages. A current lighting effect array is compared to a previous lighting effect array, and one or more compression schemes are determined for the delta between the two lighting effect arrays, and are applied to one or more zones of light emitters in the lighting effect array. A best combination of compression schemes is thus selected for each lighting effect array transition.

In embodiments, the lighting data (e.g., color & luminance/brightness) is provided for an array of light emitters (e.g., LEDs in keyboard keys or the housing) in a stream of lighting effect arrays of data sent to the peripheral. The streaming uses a compression scheme that applies to a customized grouping of light emitters that can vary lighting effect array to lighting effect array. Also, different zones can be used within a lighting effect array. For example, instead of indicating, for each position, a particular color, instead a particular color is specified once, in conjunction with a customized listing of light emitters that will have that color. A zone can be a single light emitter, a group of geographically proximate light emitters, a range of light emitter identifiers, a list of light emitter identifiers or some other combination of light emitters.

In embodiments, a method and system is provided for streaming lighting effect data in lighting effect arrays, wherein each lighting effect array has a plurality of zones of light emitter data of varying zone sizes. A different compression scheme is used for at least two of the zones. For example one zone may use no compression and another zone may use a 4-bit delta, or change, from the previous color value, where the change is small.

In embodiments, a method and system is provided for streaming lighting effect data in lighting effect arrays, wherein successive lighting effect arrays utilize different compression schemes. For each transition to a next color, a encoder examines the previous lighting effect array colors and the current lighting effect array colors, and determines an optimized grouping of light emitter identifiers and optimized compression schemes.

In embodiments, one of the compression schemes provides a difference between a previous lighting value and a new lighting value. In one embodiment, the compression schemes include no change, a complete value, a N bit delta from a last value, and a M bit delta from a last value.

DETAILED DESCRIPTION

Typical System Environment for Certain Embodiments

Figure 1:
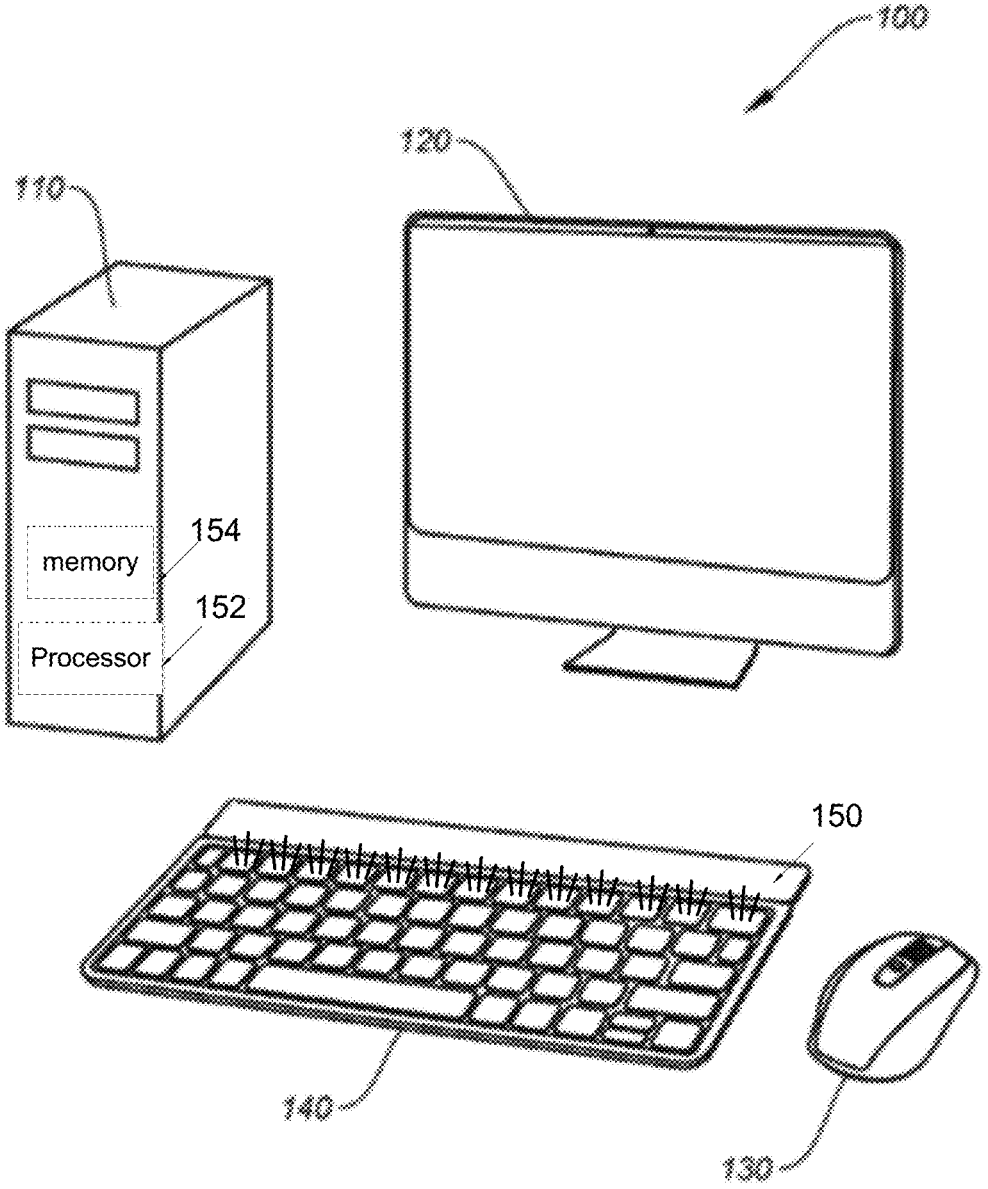
FIG. 1 is a diagram of a lighting effects computer system, according to certain embodiments.

FIG. 1 shows a system 100 utilizing streaming lighting effects to an input device 140, according to certain embodiments. System 100 may include a computer 110, a display 120, an input device 130 (e.g., "computer mouse 130"), and an input device 140 (e.g., "keyboard 140"). Keyboard 140 can include an array of keys, including a first group of keys 150 that are lit with lighting effects. For system 100, input device 130 and keyboard 140 can be configured to control aspects of computer 110 and display 120, as would be understood by one of ordinary skill in the art. Computer 110 can be referred to as a "host computer" or a "host computing device."

Computer 110 may include a machine readable medium (not shown) that is configured to store non-transitory, computer-readable computer code, such as keyboard driver software, and the like, where the computer code is stored in a memory 154 and is executable by a processor (e.g., processor(s) 152) of computer 110 to affect control of computer 110 by input devices 130 and/or 140. The various embodiments described herein generally refer to input device 140 as a keyboard or similar input device, however it should be understood that input device 140 can be any input/output (I/O) device, user interface device, control device, input unit, or the like such as a computer mouse, a remote control device, a wearable device (e.g., smart watch, wristband, glasses), a gamepad, a trackball, a steering wheel, a home control hub, a joystick, etc.

The host computing device is typically described as a desktop or laptop computing device. However, it should be understood that the host computing device can be any suitable computing device further including a tablet computer, a smart phone, a virtual or augmented reality interface (e.g., having 2D or 3D displays), a holographic interface, or the like. One of ordinary skill in the art would understand the many variations, modifications, and alternative embodiments thereof.

Figure 2:
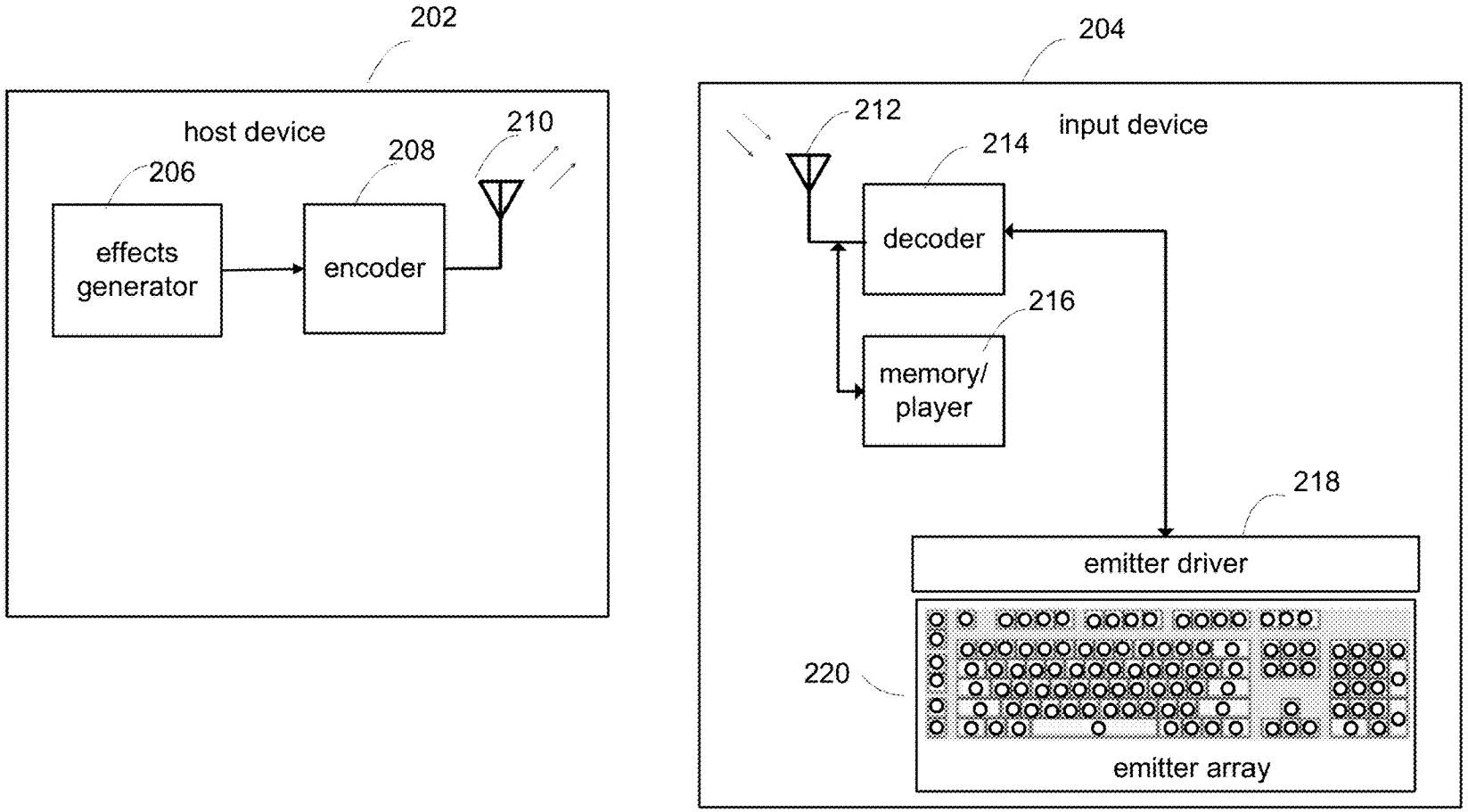
FIG. 2 is a block diagram of lighting effects modules according to an embodiment.

FIG. 2 is a block diagram of lighting effects modules according to an embodiment. A host device 202 has an effects generator 206 which provides effects to an encoder 208. Encoder 208 performs the specialized data compression and/or grouping of data, providing the compressed and/or grouped effects data to a wireless transmitter 210. An input device 204 receives the transmitted compressed effects data at a transceiver 212, and provides the data to a decoder 214. Optionally, the compressed data may be stored in a memory/player 216 for later playback. Decoder 214 decodes and/or decompresses and reproduces the original effects data from effects generator 206, and provides the effects to an emitter driver 218. Emitter driver 218 provides signals to individual emitters (e.g., LEDs) in an emitter array 220. The emitters may be beneath keys, in the housing, or in any other location on the input device 204. The emitters in emitter array 220 may be grouped into separate zones, which can vary from lighting effect array to lighting effect array, or could remain constant.

Figure 3:
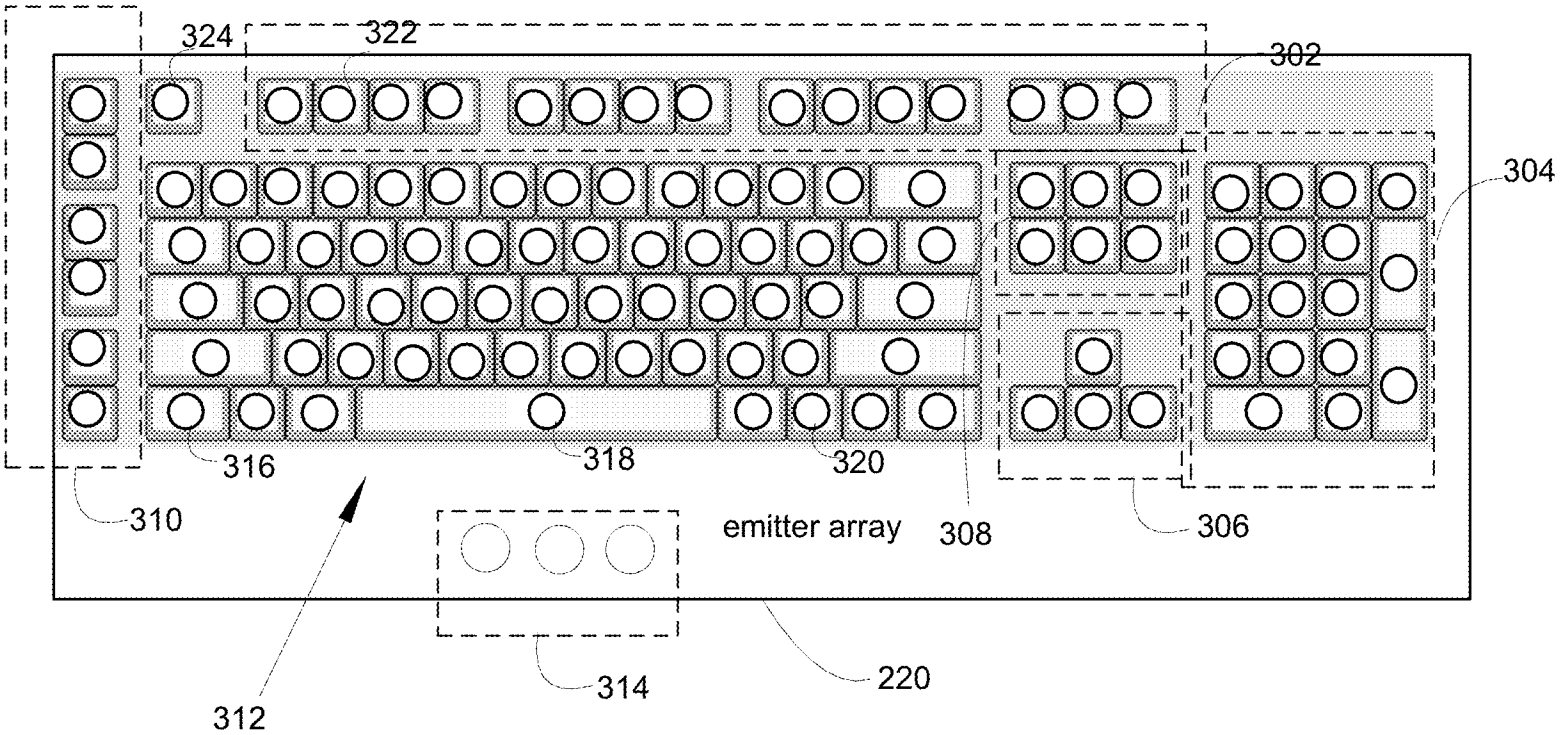
FIG. 3 is a diagram illustrating different zones of an emitter array according to an embodiment.

FIG. 3 is a diagram illustrating different zones of an emitter array according to an embodiment. Emitter array 220 from FIG. 2 is shown, with an array of LEDs shown as circles under keys shown as rectangles. Various examples of possible zones are shown. A function key zone 302 is shown for the top row. A number pad zone 304 is shown on the right. An arrow key zone 306 is shown near the bottom. Additional zones 308 and 310 are shown. The remaining emitters for keys 312 are not assigned to a zone in this example. A housing emitter zone 314 is shown with 3 emitters in the housing, but not under a key. Individual keys can be a one-key zone, or physically separated keys can be grouped to form a zone, such as keys 316, 318, 320 and 322.

In one embodiment, different zones can be used within a lighting effect array. For example, zone 304 may use a compression scheme that provides the delta between the current color of each emitter, and the color from the last lighting effect array. Note that in this example, and the following examples, although only color is described, luminance or brightness can also be specified. If the difference is small, a 4 bit delta may be used. Zone 302 may also use a delta compression scheme, but with 5 bit deltas because the difference of at least one emitter in zone 302 is greater than can be represented with 4 bits. Meanwhile, zone 308 may have had large changes in colors, so that a delta scheme is not the most efficient. Thus, zone 308 may be rendered with no compression, using the full actual value of each emitter color. All the emitters in zone 310 may be the same color, which may be significantly different and thus the full actual value is used. However, instead of specifying the full actual value for each emitter, zone 310 is identified, with the full actual value for each emitter in zone 310. Zone 314 might use the same compression scheme as zone 304. The remaining keys could be considered a separate zone 312, and might have no compression if there are lots of changes in color, or a 4 bit data compression scheme. Other compression or grouping schemes could also be used. For example, zone 403 might instead use a traditional indication of emitter location and color for each emitter, with run-length encoding being used on the combination for this zone. Alternately, a delta compression could be used to indicate the delta for each emitter in the zone, then run-length encoding could be used for the resulting data for that zone.

In one embodiment, lossless compression schemes are used. The limited size of the array allows such more precise compression schemes to be used.

In another embodiment, in addition to varying compression by zone in a lighting effect array, or without varying by zone, the normal compression process of specifying a pixel followed by a color value or delta is flipped. Instead, a particular color or delta is specified, followed by the location of the emitters in the emitter array with that color or delta. This is especially advantageous with the relatively small size of the array for a keyboard input device. For example, a keyboard may have a light emitter array that is a 6×22 array. Thus, the flip saves space. Where a delta is used, different emitters can be listed that are different colors, but happen to have changed by the same amount from the previous color of the last lighting effect array. For example, a compression scheme of 4-bit delta, with a delta value of −0110 may be assigned to each of emitters 316, 318, 320, 322 and 324. This could be expressed as follows: [−0110; 316, 318, 320, 322, 324]. Note that the indicator numbers would be replaced by the x,y location or an emitter ID of each emitter in the array, or other way of indicating emitter location, such as assigning a sequential number. The sequential number can be interpreted by decoder 214 of FIG. 2 to provide the x, y location to emitter driver 218, along with the actual color value (not just the delta). Alternately, the conversion from sequential location to x, y location could be performed in emitter driver 218, or another combination of decoding and interpreting could be used.

In another embodiment, or in combination with the above embodiments, successive lighting effect arrays may utilize different compression schemes for the entire lighting effect array, or for one or more zones. For example, zone 304 may use a 4-bit delta compression scheme in a first lighting effect array, then a 5-bit delta compression scheme in a second lighting effect array, then no compression at all in a third lighting effect array. Meanwhile, the other zones could also vary the type of compression used from lighting effect array to lighting effect array.

Figure 4:
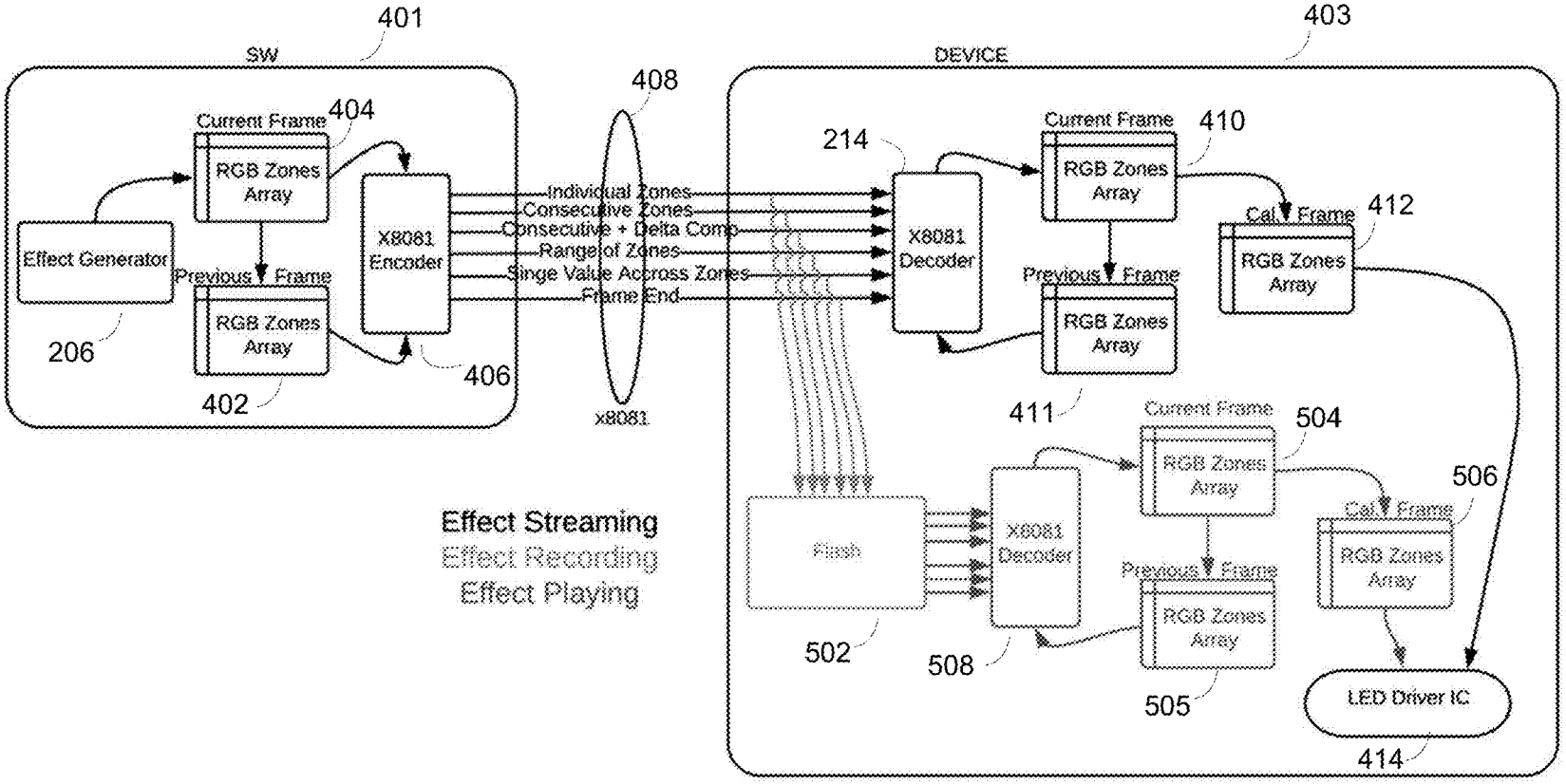
FIG. 4 is a block diagram of the software modules and electronic circuitry for transfer optimization between host software and an input device for streaming and for storing and playing back lighting effects according to embodiments.

FIG. 4 is a block diagram of the software modules and electronic circuitry for transfer optimization between host software and an input device according to an embodiment. Host software 401 stores the lighting information for a previous lighting effect array in an array memory 402 and the lighting information desired for the current lighting effect array in an array memory 404. After the current lighting effect array data is transmitted to input device 403, the contents of array 404 overwrite the contents of array 402. The lighting for the current frame will typically including a color value for each emitter and/or zone. An encoder 406 compares arrays 402 and 404 and determines what zones to divide the array into, and the best compression algorithm for each zone.

Effect Generator 206 produces effects for a particular model of the input device 403. A template with the emitter layout (number of emitters and locations for that model) is provided, and effects are generated for each emitter in that template. In one embodiment, each emitter is its own zone, and the transfer optimization analysis is done for each zone, combining zones where there are similarities in color or delta change. A zone layer may be overlaid on the template for a particular lighting effect, grouping emitters into zones, such as shown in FIG. 3. The template may identify light emitters with separate identifiers or IDs, which can be an identifier alphanumeric, an x, y location, a zone, or by any other identifier.

In one embodiment, effect generator 206 provides a lighting effect indication for an array of light emitters. The lighting effect indication can be simply data indicating a lighting effect characteristic for each light emitter in the array. Alternately, the lighting effect indication can be instructions for generating the desired lighting effect characteristic. The lighting effect characteristic can be a color value, a luminance or intensity value, or any other value. Each light emitter can have one or more characteristics which are subject to change.

In one embodiment, effect generator 206 is a video game program that produces color values for each light emitter in the array, and leaves it to encoder 406 to analyze the lighting effect indication from effect generator 206 and generate an appropriate message to the input device 403 with at least one command for a plurality of light emitter characteristics. For example, encoder 406 determines whether to convert to a compressed value or not. Encoder 406 can also configure the zones, depending on the grouping of light emitters with similar colors or changes. Alternately, effect generator 206 could specify the zones.

The configured zones, compression methods and color data or deltas are combined into a lighting effect array 408 that is transmitted to user input device 403. The lighting effect array includes at least one lighting effect array command that applies to a plurality of light emitters. The lighting effect array is received and stored in a current frame memory array 410. Decoder 214 applies the information in the lighting effect array to the previous lighting effect array stored in a previous frame memory 411. Decoder 214 will, for example, read the color value of a particular zone or light emitter from memory 411, and apply the changes from memory 410. Those changes may be adding a delta to each of the Red, Green and Blue (RGB) values, or replacing one or more with a new value. The updated LED values are provided to a calibration frame array 412 and are read using Direct Memory Access (DMA) by LED driver IC 414 and applied to the emitter array. In an alternate embodiment, memory 410 is a working memory or buffer of decoder 214, and is used to temporarily store portions of the received lighting effect array as the corresponding changes are applied to the color values in memory array 411. In yet another embodiment, arrays 410, 411 and 412 are separate portions of the same physical memory chip.

Decoder 214 can thus be very simple compared to encoder 406 in host software 401. The decoder only needs to read the compression and/or grouping scheme and apply the corresponding data to the indicated location in the array of memory 411. In one version, decoder 214 only has to determine whether to replace a color value, or add an increment. In one embodiment, a constant brightness or luminance value is used for the emitter array. The embodiments of the invention eliminate the need for the host to read the last color value from the input device, eliminating the use of channel bandwidth from the input device to the host for lighting effects. The lighting effects transfers are one-way.

In another embodiment, a brightness or luminance value is modified, the new value provided or a delta provided, similar to how colors are added. In one embodiment, the compression may be determined for each lighting effect array separately for each of Red, Green and Blue and luminance. For example, the R value may not change, while the G value could change by less than 4 bits delta, while the luminance value could change by a 5 bits delta. Separate zones and groupings can be provided for each of R, G, B and luminance.

In one embodiment, an RGB zone is the simplest RGB illuminated item that can be configured. It can be an ordinary keyboard key, an illuminated button, a LED, or any light source or group of light sources that are electrically driven together. The index of every RGB Zone in the array is the RGB Zone ID. RGB zones can be configured in three manners:

1. Individually, specifying each RGB Zone ID and RGB value;
2. By groups, specifying the Zone ID of the first zone and a group of correlative RGB values;
3. By range, specifying the start RGB Zone ID, end RGB Zone ID and the single RGB value to be propagated to all zones in the range.

FIG. 4 also shows the circuitry of device 403 modified for storing and playing back lighting effects according to an embodiment. A flash memory 502 is added for storing multiple lighting effect arrays of lighting effects. Upon playback, the stored data is provided through a separate decoder 508 to a current frame array 504 and applied to a calibration frame 506, also using a previous frame array 505, similarly to the process described above for FIG. 4 streaming effects. In one embodiment, the same physical memory for arrays 410, 411 and 412 is used. Flash memory 502 stores the absolute values for the first lighting effect array, then after that stores the deltas, new values, compression schemes and zone combinations for each subsequent key frame. Thus, a significant savings in required storage space is achieved. Upon playback, the original lighting effect array values are provided to memory 506, which can be the same physical memory as array 412. Thereafter, the decoder 508 retrieves those values, and applies any delta or new value from the next lighting effect array data, according the designated compression scheme. In one embodiment, decoders 214 and 508 are the same decoder.

A timestamp is included with each lighting effect array. For a streaming mode, if there is no change in color values in a particular lighting effect array time period, the host can simply not send a new lighting effect array, saving transmission space. Alternately, a transmission with a command indicating no change can be sent, so that the input device knows that a transmission hasn't been lost. That command, in one embodiment, is a range of all the zones, indicating 0 change. In a record and playback mode, the same no change commands can be recorded for each time period. Alternately, the decoder can examine the timestamp of the next stored lighting effect array and determine that no change is needed for a period of time.

In one embodiment, a combination of streaming and storing effects is used. A series of time slots with streamed data could end with a trigger for a stored effect pattern on the peripheral input device to be played. While the stored effect pattern is played, little or no transmission is required. The timing of using stored effects could be synchronized with times of intense input required during a gaming program, for example. The timing could be set by the gaming program, or the encoder 406 could determine time slots in which to send less data based on inputs received from the peripheral input device. For example, stored effects might be replayed when trigger input signals are being sent from the peripheral input device.

Figure 5:
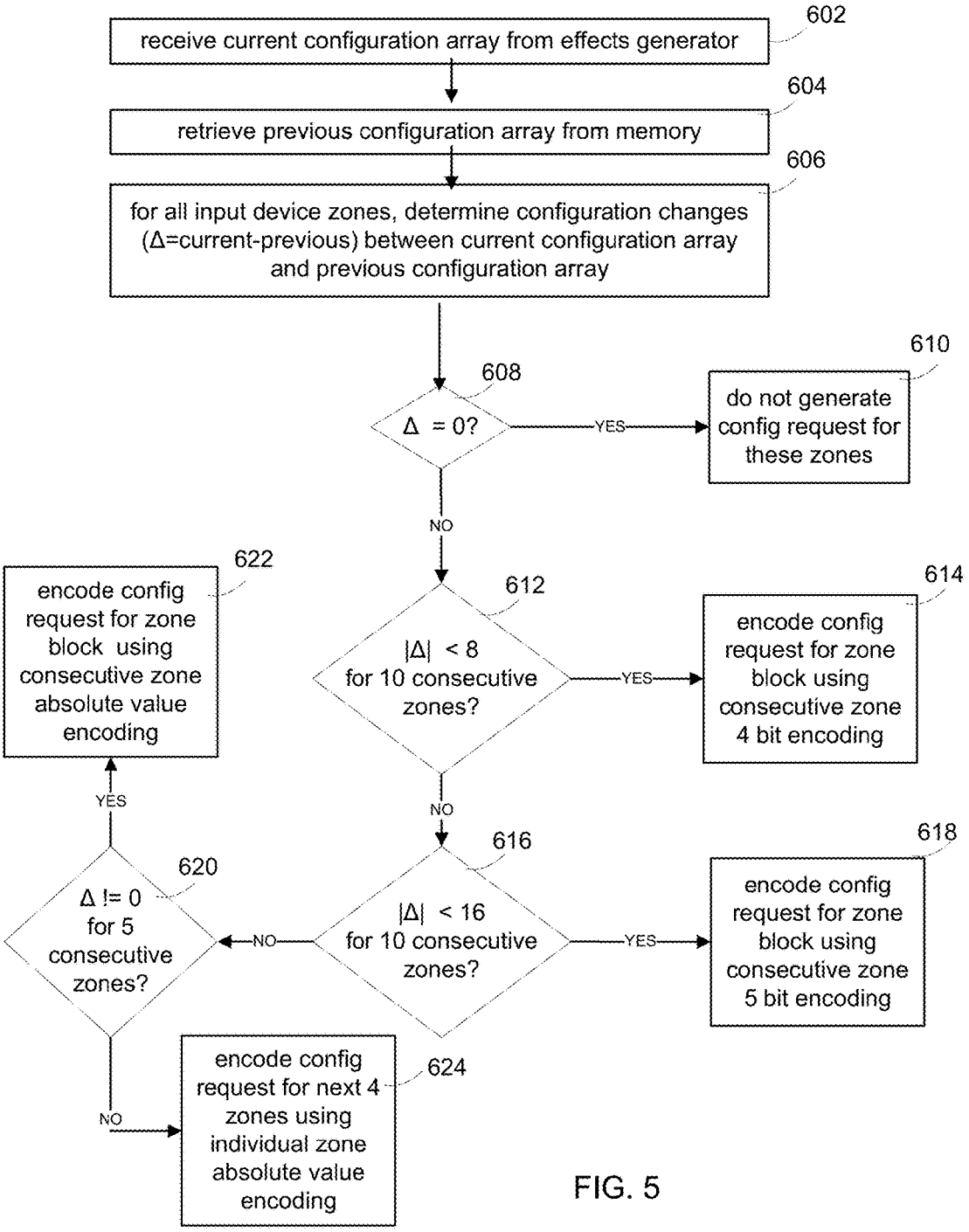
FIG. 5 is a flowchart of the determination of compression scheme to use according to an embodiment.

FIG. 5 is a flowchart of the determination of compression scheme to use according to an embodiment. First, the configuration data is received from the effects generator (step 602). The previous configuration array data is retrieved from memory (604). For all input device zones, determine configuration changes (Δ (delta)=current-previous) between the current configuration array and the previous configuration array (606). If the delta is 0 (608), no configuration request needs to be generated for these zones (610). If the absolute value of the delta is less than 8 (612), that can be indicated with 4 bit encoding, and a configuration request with a 4 bit delta compression is selected (614). If the absolute value of the delta is 8 or more, but is less than 16 (616), then 5 bit delta encoding can be used (618). If the delta is 16 or more, then the absolute value of the new color is transferred. This can be done two ways (622, 624) depending up whether Δ !=0 (the delta is not zero). If Delta=0 the RGB zone does not need to be addressed, but if it is in the middle of a sequence of consecutive RGB zones to be configured, then the 0 value for Delta is valid. At the end of this process, each zone will have a configuration value which is either 0, a 4-bit delta, a 5-bit delta, or a new absolute value of the color. Alternately, other ways to code the delta could be used, such as using more or less bits for it. Additionally, other ways to group the RGB zones could be used, such as, e.g., not consecutive but by arbitrary groups which could be defined at a configuration state and accessed by a single group index using a new command. The process is done for each of R, G and B for each emitter in the array. Alternately, other color schemes than RGB could be used, such as YUV, depending on the type of emitter used.

Figure 6:
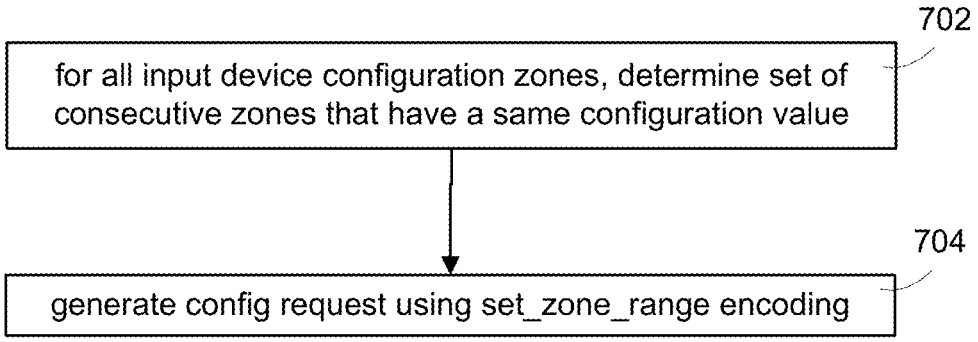
FIGS. 6 and 7 are flowcharts illustrating the choice of range vs. single encoding according to an embodiment.
Figure 7:
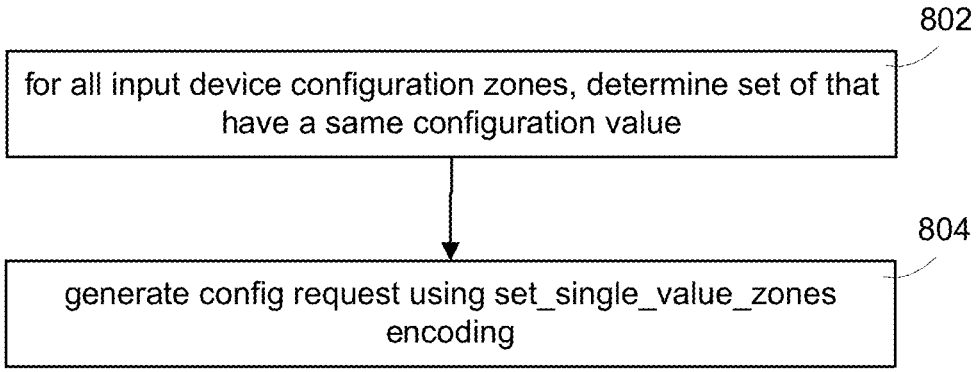

FIGS. 6 and 7 are flowcharts illustrating the choice of range vs. single encoding according to an embodiment. After the configuration values have been determined as in FIG. 5, a set of zones that have the same configuration value are determined (702). For example, multiple consecutive zones may have a configuration value of 0, or a delta of 0110, etc. For these consecutive zones, a zone range is set for the configuration request (704). As shown in FIG. 7, non-consecutive zones with the same configuration value are then determined (802). Encoding is done by specifying the configuration value (e.g., 4-bit delta 1001), followed by the list of zones with that value (804).

Figure 8:
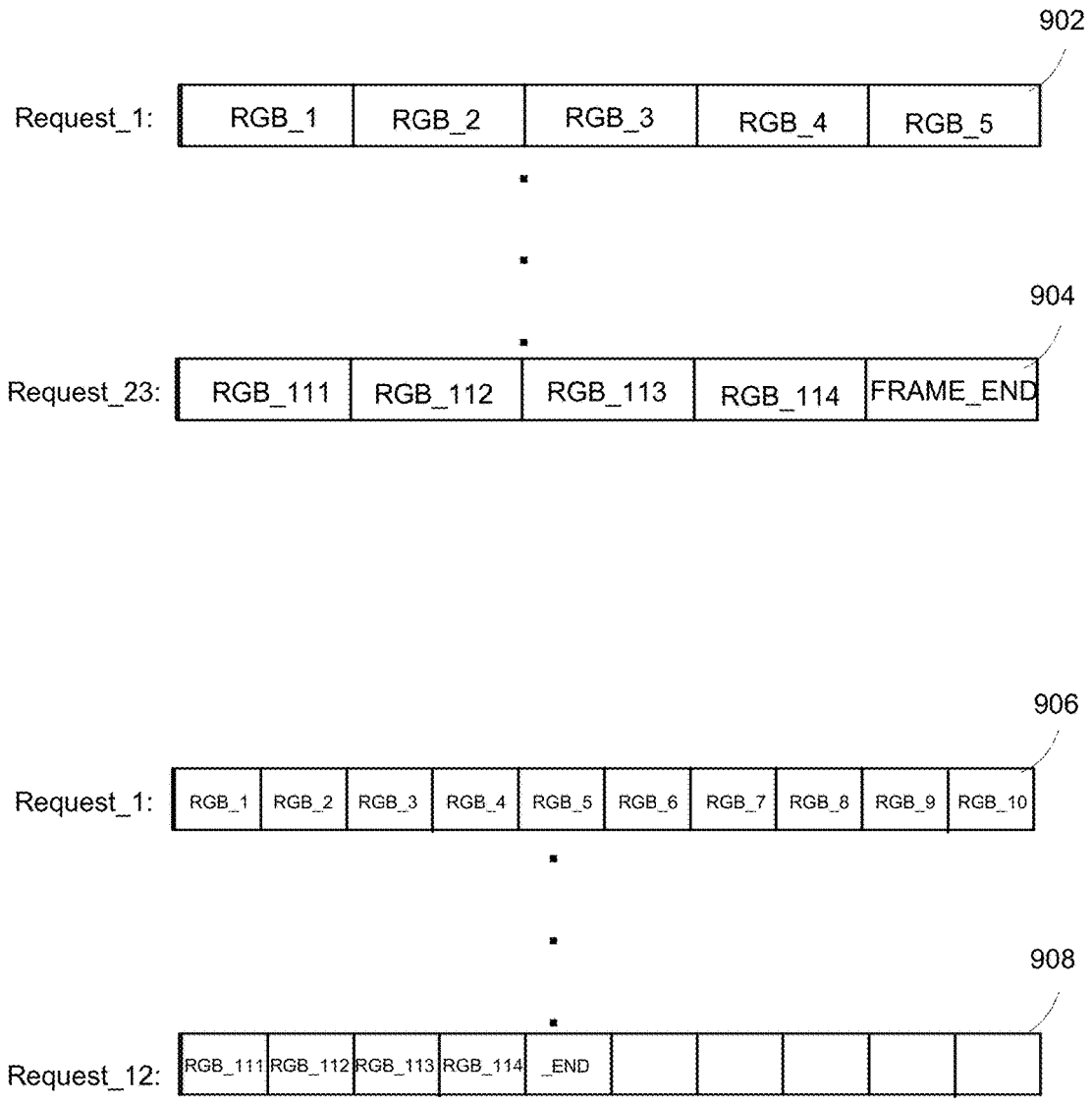
FIG. 8 is a diagram illustrating the savings of time slot space according to an embodiment.

FIG. 8 is a diagram illustrating the savings of time slot space according to an embodiment. In one embodiment, a wireless channel between the host and the input device is used, such as a particular RF frequency or range (e.g., 2.4 GHz). The lighting effects are time multiplexed, and confined to a portion of each time period, to allow transmission of input data from the input device (e.g., key presses, mouse movements, etc.). In an embodiment, each lighting effect array is transmitted over multiple timeslots, with at least 50% of each timeslot reserved for input device transmissions to the computer. In one embodiment, the RGB configuration messages travel from a PC to the device in the acknowledge message from the PC to the mouse input data messages. Therefore the maximum number of RGB configuration messages per mouse input data message is 1.

FIG. 8 graphically shows requests 1 (902) through 23 (904) with no compression. The FIG. 8 example assumes a maximum request payload of 16 bytes. With no compression each RGB zone is three bytes. This gives a maximum of 5 zones per request if no compression is used. A typical keyboard has 114 RGB zones and so this requires 114/5, or 23, request messages to provide one lighting effect array of effects data. At 1 ms per request, this requires 23 ms to send one lighting effect array.

Using 4-bit delta compression according to an embodiment of the invention, the space is cut in half, with only 12 requests required (906, 908). With 4-bit delta compression (delta <8 for all RGB zones), this allows for 10 RGB zones per request. Using the same assumptions, this requires 114/10, or 12, request messages per frame. At 1 ms per request, this requires only 12 ms to send one lighting effect array, a reduction of 50%. There is additional overhead to indicate the different compression schemes used, and the different groups of zones. However, this is offset by the reduction from the need to specify a particular value only once, then listing the affected emitters, rather than having to list the value separately for each emitter.

Embodiments of the present invention minimize bandwidth for transferring light effects (streaming or storing), thus minimizing impact on RF link performance and power consumption (battery life). The size of lighting effects stored on-board an input device is minimized, thus enabling longer effects with the same memory size. Effects stored on-board can be virtually the same as the ones streamed. Thus, the player and the decoder in the device consist of the same exact firmware module. Additionally, the design lowers development effort, optimizes application flash memory size, and reduces the risk of bugs.

Embodiments of the present invention provide compression at the software level to optimize transfers and storage. The input device logic is simplified, since there is no need to further encode/decode for compression on board the input device. By using less bandwidth, the probability of a RF collision with a transfer from other 2.4 GHz device is reduced. By sending little data in each timeslot, collisions are generally avoided. If there is a collision, it can be detected (e.g., with parity bits and bytes), and the data can be re-sent.

Power Save Mode

In one embodiment, a power save mode is provided for the lighting effects. Power can be saved by not requiring the transceiver to receive and acknowledge lighting effects. Instead, stored effects can be played. The power for stored effects can be saved by reducing the number or frequency of color transitions, reducing the luminance or brightness of the light emitters or choosing colors which require less luminance and thus less power to the light emitter. Additionally, only a subset of light emitters could be lit, such as important zones, every other light emitter, etc.

Modifications to Embodiments

Some embodiments include electronic components, such as microprocessors, storage and memory that store computer program instructions in a computer readable storage medium. Many of the features described in this specification may be implemented as processes that are specified as a set of program instructions encoded on a computer readable storage medium. When these program instructions are executed by one or more processing units, they cause the processing unit(s) to perform various operation indicated in the program instructions. Examples of program instructions or computer code include machine code, such as is produced by a compiler, and files including higher-level code that are executed by a computer, an electronic component, or a microprocessor using an interpreter.

It will be appreciated that computer 110, host device 202, keyboard 140 and input device 204 are illustrative and that variations and modifications are possible. Computer systems used in connection with embodiments of the present invention may have other capabilities not specifically described here. Further, while host device 202 and input device 204 are described with reference to particular blocks, it is to be understood that these blocks are defined for convenience of description and are not intended to imply a particular physical arrangement of component parts. For instance, different blocks may be but need not be located in the same facility, in the same server rack, or on the same motherboard. Further, the blocks need not correspond to physically distinct components. Blocks may be configured to perform various operations, e.g., by programming a processor or providing appropriate control circuitry, and various blocks might or might not be reconfigurable depending on how the initial configuration is obtained. Embodiments of the present invention may be realized in a variety of apparatus including electronic devices implemented using any combination of circuitry and software.

While the invention has been described with respect to specific embodiments, one skilled in the art will recognize that numerous modifications are possible. Embodiments of the invention may be realized using a variety of computer systems and communication technologies including but not limited to specific examples described herein.

Embodiments of the present invention may be realized using any combination of dedicated components and/or programmable processors and/or other programmable devices. The various processes described herein may be implemented on the same processor or different processors in any combination. Where components are described as being configured to perform certain operations, such configuration may be accomplished, e.g., by designing electronic circuits to perform the operation, by programming programmable electronic circuits (such as microprocessors) to perform the operation, or any combination thereof. Further, while the embodiments described above may make reference to specific hardware and software components, those skilled in the art will appreciate that different combinations of hardware and/or software components may also be used and that particular operations described as being implemented in hardware might also be implemented in software or vice versa.

Computer programs incorporating various features of the present invention may be encoded and stored on various computer readable storage media; suitable media include magnetic disk or tape, optical storage media such as compact disk (CD) or DVD (digital versatile disk), flash memory, and other non-transitory media. Computer readable media encoded with the program code may be packaged with a compatible electronic device, or the program code may be provided separately from electronic devices (e.g., via Internet download or as a separately packaged computer-readable storage medium).

As described, the inventive method may involve implementing one or more functions, processes, operations or method steps. In some embodiments, the functions, processes, operations or method steps may be implemented as a result of the execution of a set of instructions or software code by a suitably-programmed computing device, microprocessor, data processor, or the like. The set of instructions or software code may be stored in a memory or other form of data storage element which is accessed by the computing device, microprocessor, etc. In other embodiments, the functions, processes, operations or method steps may be implemented by firmware or a dedicated processor, integrated circuit, etc.

It should be understood that the present invention as described above can be implemented in the form of control logic using computer software in a modular or integrated manner. Based on the disclosure and teachings provided herein, a person of ordinary skill in the art will know and appreciate other ways and/or methods to implement the present invention using hardware and a combination of hardware and software.

Any of the software components or functions described in this application may be implemented as software code to be executed by a processor using any suitable computer language such as, for example, Java, C++ or Perl using, for example, conventional or object-oriented techniques. The software code may be stored as a series of instructions, or commands on a computer-readable medium, such as a random access memory (RAM), a read-only memory (ROM), a magnetic medium such as a hard-drive or a floppy disk, or an optical medium such as a CD-ROM. Any such computer-readable medium may reside on or within a single computational apparatus, and may be present on or within different computational apparatuses within a system or network.

While certain exemplary embodiments have been described in detail and shown in the accompanying drawings, it is to be understood that such embodiments are merely illustrative of and not intended to be restrictive of the broad invention, and that this invention is not to be limited to the specific arrangements and constructions shown and described, since various other modifications may occur to those with ordinary skill in the art. For example, memory arrays 302 and 404 could be different parts of the same memory or separate memories. The decoding block 214 could be a single decoder, or separate decoders for streaming and recording and playback modes. The effects could be haptic or other effects than lighting.

Thus, although the invention has been described with respect to specific embodiments, it will be appreciated that the invention is intended to cover all modifications and equivalents within the scope of the following claims.

What is claimed is:

1. A method comprising:

at a host:

storing a light emitter template for a peripheral input device, the light emitter template having an identifier for each light emitter in an array of light emitters in the peripheral input device;

analyzing a lighting effect indication for the array of light emitters;

determining, from the lighting effect indication, any change in a characteristic for each light emitter in the array for a transition time;

associating the change in characteristic with a corresponding identifier for each light emitter in the array of light emitters; and for each transition time in the lighting effect, generating a lighting effect array message for wireless transmission to the peripheral device, the lighting effect array message producing a single lighting effect array command for a plurality of the light emitters;

at the peripheral input device with the array of light emitters:

storing in a memory an array of light emitter characteristics, with at least one light emitter characteristic for each light emitter in the array of light emitters;

decoding the lighting effect array command to determine a change in light emitter characteristic for each light emitter in the array of light emitters;

applying the change in light emitter characteristic to the light emitter characteristics in the array of light emitter characteristics in the memory;

controlling the light emitter characteristics of the light emitters with the light emitter characteristics in the memory; and changing the plurality of the light emitters responsive to the light emitter characteristics of the light emitters in the memory as changed by the lighting effect array command.

2. The method of claim 1, wherein the lighting effect array message provides a plurality of separate compression schemes, and wherein one of the separate compression schemes indicates a particular color once, in combination with the light emitter identifiers for all light emitters with that particular color.

3. The method of claim 1, further comprising using separate compression schemes for different zones in the lighting effect array for at least one of the transitions.

4. The method of claim 1, wherein successive lighting effect arrays utilize different compression schemes.

5. The method of claim 1 wherein the lighting effect array message includes a plurality of compression schemes including a n-bit delta for a first group of light emitter identifiers, a m-bit delta for a second group of light emitter identifiers and no compression for a third group of light emitter identifiers.

6. The method of claim 1 further comprising:

obtaining a color value for each light emitter identifier from a first array in a memory of a host corresponding to a previous lighting effect array;

obtaining a color value for each light emitter identifier from a second array in the memory of the host corresponding to a current lighting effect array;

comparing the color values from the previous and current lighting effect arrays for each light emitter identifier in a transfer module in the host; and generating a lighting effect array for wireless transmission to the peripheral using a plurality of compression schemes.

7. The method of claim 6 wherein the color values are red (R), green (G) and blue (B), with one of the color value or color value delta being specified for each of R, G and B for each light emitter identifier.

8. The method of claim 7 wherein RGB zones are specified by a combination of at least two of:

individually, specifying each RGB zone ID and RGB value;

by groups, specifying a zone ID of a first zone and a group of correlative RGB values; and by range, specifying a start RGB zone ID, an end RGB zone ID and a single RGB value to be propagated to all zones in the range.

9. The method of claim 1 wherein the peripheral input device is an input device having at least one key, with at least one of the array of light emitters being associated with the at least one key.

10. The method of claim 1, wherein at least one lighting effect array message for wireless transmission to the peripheral device comprises:

an indication of individual light emitter identifiers and corresponding individual light emitter color values;

an indication of consecutive light emitter identifiers and corresponding color value deltas; and an indication of a zone of light emitter identifiers and corresponding color value deltas.

11. A system comprising:

a peripheral input device having an array of light emitters;

a non-transitory, computer readable media containing instructions to be implemented on a host for:

providing a light emitter template for a peripheral input device, the light emitter template having an identifier for each light emitter in an array of light emitters in the peripheral input device;

analyzing a lighting effect indicator for the array of light emitters;

determining, from the lighting effect indicator, a series of color transitions for each light emitter in the array for a transition time;

associating the series of color transitions with a corresponding identifier for each light emitter in the array of light emitters; and for each transition time in the lighting effect, generating a lighting effect array message for wireless transmission to the peripheral device, the lighting effect array message producing a single lighting effect array command for a plurality of the light emitters;

the peripheral input device comprising:

the array of light emitters;

a wireless receiver;

a peripheral input device memory storing color values for each light emitter in the array of light emitters;

a lighting effects decoder that is operatively connected to the peripheral memory and the wireless receiver, the lighting effects decoder being configured to decode the lighting effect array message and apply changes in color value to the color values in the array of light emitters in the peripheral input device memory; and a light emitter driver connected between the peripheral memory and the array of light emitters to control the color of the light emitters using the color values in the peripheral input device memory.

12. The system of claim 11, wherein the peripheral input device further comprises:

a second memory array for storing a received lighting effect array.

13. The system of claim 11, wherein the peripheral input device is an input device having at least one key, with at least one of the array of light emitters being associated with the at least one key.

14. The system of claim 13, wherein the peripheral input device is one of a keyboard, computer mouse, trackball, gamepad, joystick, steering wheel and remote control.

15. The system of claim 11, wherein the lighting effect array message includes a plurality of compression schemes and wherein one of the separate compression schemes indicates a particular color once, in combination with the light emitter identifiers for all light emitters with that particular color.

16. The system of claim 11, wherein a composition of the light emitters in at least two zones varies after at least one of the transitions.

17. The system of claim 11, wherein a compression scheme is used which varies between at least two zones in a lighting effect array.

18. The system of claim 11, wherein successive lighting effect arrays utilize different compression schemes.

19. A peripheral input device comprising:

a housing;

an array of light emitters mounted in the housing;

a wireless receiver;

a first input device memory storing current light emitter characteristics for the array of light emitters;

a second input device memory for storing a received lighting effect array command for a plurality of the light emitters;

a lighting effects decoder that is operatively connected to the first input device memory and the second input device memory, the lighting effects decoder configured to apply the received command to the light emitter characteristics in the first input device memory; and a light emitter driver connected between the first input device memory and the array of light emitters.

20. The input device of claim 19, wherein the first and second input device memories are both part of a single physical memory, and the input device is one of a keyboard, computer mouse, trackball, gamepad, joystick, steering wheel and remote control wherein a particular lighting zone for the peripheral input device includes at least one light emitter.

* * * * *